US009972199B1

(12) United States Patent
Liu et al.

(10) Patent No.: US 9,972,199 B1
(45) Date of Patent: May 15, 2018

(54) TRAFFIC SIGNAL CONTROL THAT INCORPORATES NON-MOTORIZED TRAFFIC INFORMATION

(71) Applicant: FUJITSU LIMITED, Kawasaki-shi, Kanagawa (JP)

(72) Inventors: Ying Liu, San Jose, CA (US); Lei Liu, San Jose, CA (US); Wei-Peng Chen, Fremont, CA (US)

(73) Assignee: FUJITSU LIMITED, Kawasaki (JP)

( * ) Notice: Subject to any disclaimer, the term of this patent is extended or adjusted under 35 U.S.C. 154(b) by 0 days. days.

(21) Appl. No.: 15/453,854

(22) Filed: Mar. 8, 2017

(51) Int. Cl.
*G08G 1/095* (2006.01)
*G08G 1/005* (2006.01)

(52) U.S. Cl.
CPC ..... *G08G 1/005* (2013.01)

(58) Field of Classification Search
CPC .. G06N 3/0454; G06N 99/005; G08G 1/0133; G08G 1/08
See application file for complete search history.

(56) References Cited

U.S. PATENT DOCUMENTS 9,818,297 B2 11/2017 El-Tantawy et al.
2013/0176146 A1* 7/2013 Dusparic ..... G08G 1/08 340/907
2014/0114885 A1* 4/2014 Han ..... G06N 3/0454 706/12
2015/0102945 A1* 4/2015 El-Tantawy ..... G08G 1/081 340/909
2015/0134180 A1* 5/2015 An ..... G01C 21/34 701/23

OTHER PUBLICATIONS

"Traffic Signal Control Systems," National Transportation Library, Chapter 3, https://ntl.bts.gov/lib/jpodocs/edldocs1/13480/ch3.pdf, Retrieved Mar. 8, 2017.
"Traffic Signals" http://www1.toronto.ca/wps/portal/contentonlyvgnextoid=9452722c231ec410VgnVCM10000071d60f89RCRD (1998).
DOT Library, NYC DOT (2017).
Hands on Control, New South Whales Transport Management Centre (2015).
How Insync Works, http://rhythmtraffic.com/how-insync-works/, retrieved Mar. 8, 2017.
Selinger. M., Adaptive Traffic Control Systems in the United States: Updated Summary and Comparison, HDR Engineering, Inc. (2010).
(Continued)

*Primary Examiner* — Fabricio R Murillo Garcia
(74) *Attorney, Agent, or Firm* — Maschoff Brennan

(57) ABSTRACT

Technologies are described to provide control of traffic signals based at least in part on the presence of non-motorized users. In some examples, a system may include at least one sensor configured to autonomously acquire motorized user presence data at an intersection, and at least one sensor configured to autonomously acquire non-motorized user presence data at the intersection. The system may also include an agent configured to determine a motorized user queue length based on the motorized user presence data, determine a non-motorized user queue length based on the non-motorized user presence data, and control the traffic signals based at least in part on the non-motorized user queue length.

20 Claims, 11 Drawing Sheets

(56) References Cited

OTHER PUBLICATIONS

M. Luo., For Exercise in New York Futility, Push Button, New York Times, (Feb. 27, 2004).
Traffic sensors give bicyclists green lights, The Columbus Dispatch, (Jan. 30, 2013).
"Learning Traffic Light Control policies," http://cs229.stanford.edu/proj2005/RobinsonMosherEgnerLearningTrafficLightControlPolicies.pdf,(2005).
K.J.Prabuchandran, et al., "Multi-agent reinforcement learning for traffic signal control," 2014 IEEE 17th International Conference on Intelligent Transportation Systems (ITSC) (2014).
Sahar Araghi, et al., "Intelligent Traffic Light Control of Isolated Intersections Using Machine Learning Methods," 2013 IEEE International Conference on Systems, Man, and Cybernetics. (2013).
M. Abdoos, et al., "Traffic light control in non-stationary environments based on multi agent Q-learning," 2011 14th International IEEE Conference on Intelligent Transportation Systems (ITSC) (Oct. 5, 2011).
Richard Sutton and Andrew Barto, "Reinforcement Learning: An Introduction," MIT Press, 1998.
Non-Final Office Action issued Mar. 22, 2018 in corresponding U.S. Appl. No. 15/641,434.

* cited by examiner

TRAFFIC SIGNAL CONTROL THAT INCORPORATES NON-MOTORIZED TRAFFIC INFORMATION

FIELD

The described technology relates generally to control of traffic signals.

BACKGROUND

Traffic congestion is becoming an increasing concern. Traffic congestion typically results from increased use of the roads by vehicles, and is characterized by slower vehicle speeds, longer trip times, and increased vehicular queuing. Traffic signals have been widely deployed in an attempt to help alleviate traffic congestion. Proper functioning traffic signals need to not only ensure that traffic moves smoothly and safely, but that pedestrians are protected when crossing the roads.

Various traffic signal control techniques have been proposed. These techniques can be generally categorized as fixed time control, dynamic control, coordinated control, and adaptive control. Fixed time control is rather simple in that traffic signals are changed after a fixed time period. The time period can be pre-configured to different values for different times in a day. Dynamic control incorporates the use of input from detectors, such as sensors, to adjust the traffic signal timing. These detectors can inform the traffic signal controller whether vehicles are present.

Coordinated control is coordinated control of multiple traffic signals, typically by a master controller, which accounts for changing traffic patterns in real-time. Cameras and sensors are used to detect real-time traffic information, and the central controller uses this information to do real-time optimization. One optimization is a "green wave," which is a long string of green lights that allows vehicles to travel long distances without encountering a red light.

Adaptive control incorporates actual traffic demand in the control of traffic signals. Sensors and cameras are used to determine the number of vehicles at an intersection and how long the vehicles have been waiting. The traffic signal controller at this intersection uses this information to control the traffic signal at this intersection, while coordinating its decision with controllers at other intersections.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

According to some examples, traffic signal control systems configured to control traffic signals at an intersection are described. An example system may include at least one sensor configured to autonomously acquire motorized user presence data at an intersection, and at least one sensor configured to autonomously acquire non-motorized user presence data at the intersection. The system may also include an agent configured to determine a motorized user queue length based on the motorized user presence data, determine a non-motorized user queue length based on the non-motorized user presence data, and control the traffic signals based at least in part on the non-motorized user queue length.

The objects and advantages of the embodiments will be realized and achieved at least by the elements, features, and combinations particularly pointed out in the claims. Both the foregoing general description and the following detailed description are given as examples, are explanatory and are not restrictive of the invention, as claimed.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
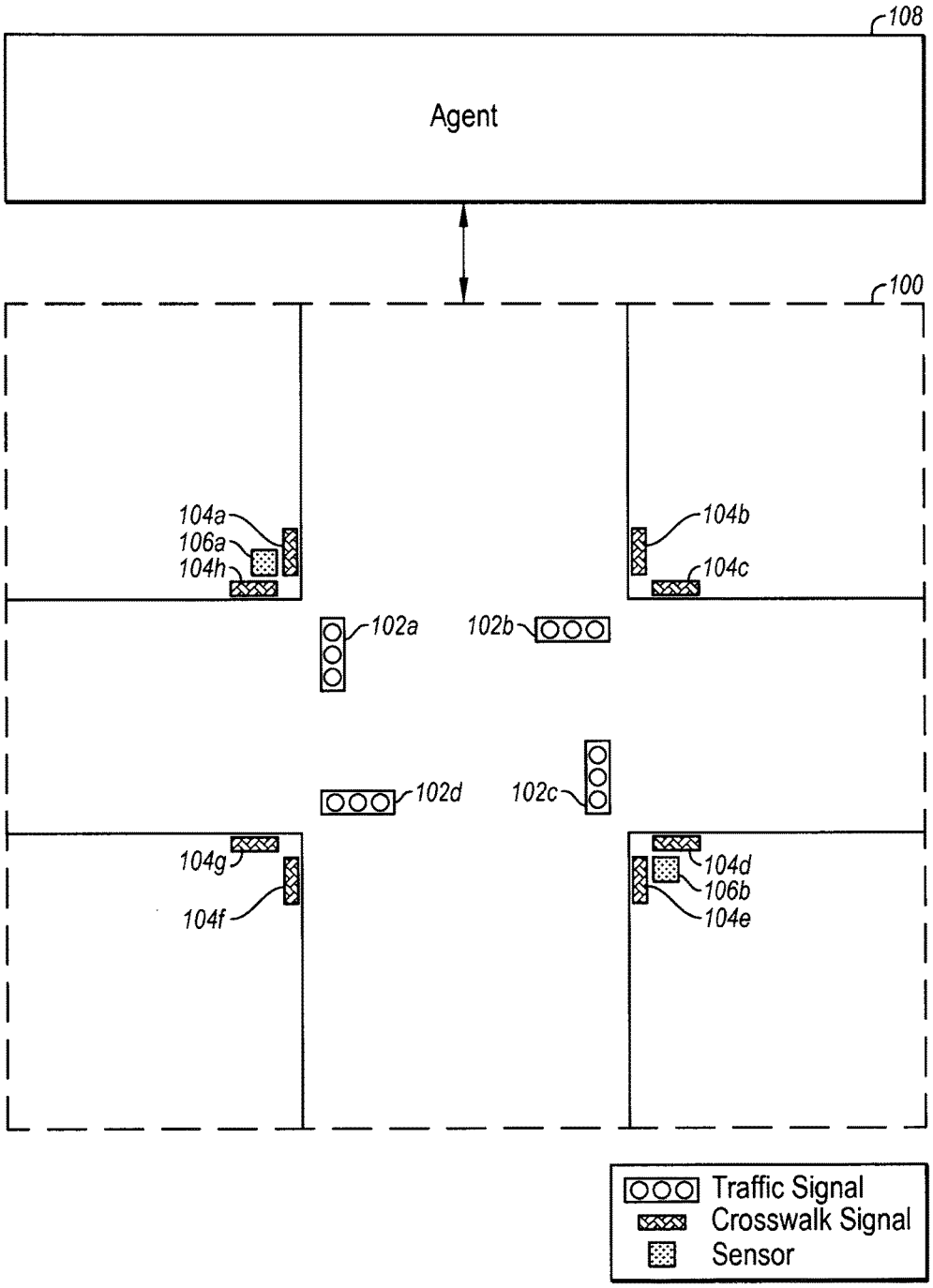
FIG. 1 illustrates selected components of an intersection controlled by traffic signals.

all arranged in accordance with at least some embodiments described herein.

DESCRIPTION OF EMBODIMENTS

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. The aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to technologies, including methods, apparatus, systems, devices, and/or computer program products related to traffic signal control that incorporates non-motorized traffic information.

Technologies are described that incorporate non-motorized traffic information in the control of traffic signals. Non-motorized traffic is the presence on or use of roadways by non-motorized users, such as pedestrians, bicyclists, and equestrians. Unlike conventional traffic control systems that require manual activation by non-motorized users to inform of their presence at intersections, the presence of such non-motorized users are autonomously detected and accounted for in the control of traffic signals at intersections. The autonomous detection of non-motorized users allows for the safe and efficient flow of both motorized and non-motorized traffic through intersections where traffic flow is being controlled by traffic signals.

In some embodiments, sensors, such as cameras, video cameras, etc., are deployed at intersections to autonomously acquire images (e.g., video images, video feed, etc.) from which the presence of motorized and non-motorized users at the intersections may be determined. Images that include or show the presence of motorized users may be referred to or classified as motorized user presence data. Images that include or show the presence of non-motorized users may be referred to or classified as non-motorized user presence data. As such, images that include or show the presence of both motorized and non-motorized users may be referred to or classified as both motorized user presence data and non-motorized user presence data. Other data from which presence of motorized users may be determined may also be referred to or classified as motorized user presence data. Likewise, other data from which presence of non-motorized users may be determined may also be referred to or classified as non-motorized user presence data.

The autonomously acquired images may also be used to determine different queues of non-motorized users and the lengths of the different queues of non-motorized users, for example, from position and/or direction of travel of the non-motorized users. Likewise, the images may also be used to determine the presence of motorized users (e.g., queue of motorized users) at the intersection, and the different queues of motorized users and the lengths of the different queues of motorized users, for example, from position and/or direction of travel of the motorized users.

Traffic signals at an intersection may include traffic signals for motorized traffic, and traffic signals for non-motorized traffic. The traffic signals for motorized traffic control, guide or direct the flow of motorized users through the intersection. The traffic signals for non-motorized traffic control, guide or direct the flow of non-motorized users through the intersection. The traffic signals at an intersection may be controlled by a control agent (an "agent").

An agent may be configured to generate control actions for both the traffic signals for motorized traffic and the traffic signals for non-motorized traffic at an intersection based on the presence of motorized users and non-motorized users at the intersection. For example, the agent may process the motorized user presence data and the non-motorized user presence data to determine the presence of motorized user queues and queue lengths, and non-motorized user queues and queue lengths present at the intersection. The agent may generate control actions for the traffic signals based at least in part on the presence of the non-motorized user queues and queue lengths.

In some embodiments, the agent may apply Q-learning, which is a model-free reinforcement learning technique, to generate the control actions for the traffic signals. Q-learning can be used to determine an optimal action-selection policy for any given (finite) Markov decision process (MDP). Q-learning works by learning an action-value function that provides an expected utility of taking a given action (e.g., generating a given control action) in a given state (e.g., given state of the traffic signals) and following the optimal policy thereafter. Examples of policies may be to minimize the length of all queues, both motorized and non-motorized user queues, at the intersection, optimize motorized traffic flow through the intersection, optimize non-motorized traffic flow through the intersection, prioritize traffic flow in a specific direction through the intersection, prioritize public transportation through the intersection, optimize global traffic flow, optimize emission utility, optimize congestion utility, and the like.

In some embodiments, the agent may apply one or more constraints on the operation of the traffic signals in generating the control actions for the traffic signals. In the normal operation of traffic signals at an intersection, certain control actions may not directly follow some other control actions. For example, when pedestrians are crossing the intersection, the traffic signal that is directing the pedestrians to cross the intersection should maintain its action (e.g., green light) for a sufficient period of time while the pedestrians are crossing the intersection. Likewise, a traffic signal that is controlling (i.e., stopping) the flow of motorized users across the flow of pedestrians should not turn green. As another example, flow of motorized traffic in one direction through the intersection may not be followed by a flow of motorized traffic in another direction through the intersection. The constraints may be different depending on the region. For example, the constraints for a four-way intersection may be different than the constraints for a three-way intersection. As another example, constraints in the United States may be different than the constraints in Japan.

In some embodiments, the agent may incorporate historical traffic data in generating the control actions for the traffic signals at the intersection. The historical traffic data may include traffic statistics at different time periods in a day (e.g., traffic between 7:00 AM to 9:00 AM is heavier than between 10:00 AM to 11:00 AM), traffic statistics in the same time period on different days (e.g., traffic between 10:00 AM to 12 Noon on weekdays or on weekend), etc. The historical traffic data may be data of the same intersection (i.e., the intersection being controlled by the agent). The historical traffic data may be data of another, different intersection. The historical data may be data of multiple intersections. For example, the agent may apply an autoregressive integrated moving average (ARIMA) model to calculate estimated instantaneous rewards based on historical traffic data, and integrate the calculated instantaneous rewards in the generating of the control actions.

In some embodiments, the agent may transmit or provide its traffic data (i.e., traffic data of the intersection) to one or more neighbor agents (i.e., agents that control neighbor intersections). This allows the neighbor agents to incorporate traffic data of this intersection in generating control actions for the traffic signals at the neighbor intersections. Additionally or alternatively, the agent may transmit or provide its traffic data to a central controller for use by the central controller and/or dissemination by the central controller, for example, to other agents. This allows for the propagation and use of traffic data of one intersection to one or more agents at other intersections.

In some embodiments, the agent may incorporate traffic data of one or more neighbor intersections in generating the control actions for the traffic signals at the intersection. For example, a neighbor agent (i.e., an agent controlling a neighbor intersection) may transmit traffic data of the neighbor intersection for use by the agent. Additionally or alternatively, a coordinator system may transmit or provide traffic data, such as real-time traffic statistics, historical traffic statistics, etc., of one or more intersections for use by the agent. Integration of neighboring intersection traffic data, including traffic data of larger geographical areas, may allow the agent to coordinate the control with different agents to improve traffic signal control efficiency.

In some embodiments, the coordinator system may transmit or provide motorized user route information and/or non-motorized user route information for use by the agent in generating the control actions. For example, people may be encouraged (e.g., provided certain benefits, such as reduced travel time due to traffic light control in their favor) to provide and share their route information to improve their travel experience. The coordinator system may then collect this information from, for example, mobile applications, cell phones, global positioning system (GPS) units, vehicle navigation systems, etc., of these users. The coordinator system may use traffic data of one or more intersections to determine improved routes for some or all of the people who have shared their route information. Additionally or alternatively, the coordinator system may provide some or all of the collected user information to the agents for use in generating the control actions.

In some embodiments, the coordinator system may receive information regarding intended destinations from self-driving (autonomous) vehicles. Using this information, the coordinator system may recommend candidates routes to the intended destinations to the self-driving vehicles. Additionally or alternatively, the coordinator system may share the route information with the agents to optimize the traffic flow.

FIG. 1 illustrates selected components of an intersection 100 controlled by traffic signals, arranged in accordance with at least some embodiments described herein. Intersection 100 is a four-way, +-shaped intersection, and includes traffic signals 102*a*, 102*b*, 102*c*, and 102*d* (collectively referred to herein as traffic signals 102), crosswalk signals 104*a*, 104*b*, 104*c*, 104*d*, 104*e*, 104*f*, 104*g*, and 104*h* (collectively referred to herein as crosswalk signals 104), and sensors 106*a* and 106*b* (collectively referred to herein as sensors 106). The number of components depicted in intersection 100 is for illustration, and one skilled in the art will appreciate that there may be a different number of traffic signals 102, crosswalk signals 104, and sensors 106. As depicted, intersection 100 is coupled to an agent 108 whose task is to control the flow of traffic through intersection 100.

Traffic signals 102 are traffic signals that direct the flow of motorized traffic through intersection 100. For example, traffic signal 102*a* may direct the flow of motorized users in the east-west direction, traffic signal 102*b* may direct the flow of motorized users in the south-north direction, traffic signal 102*c* may direct the flow of motorized users in the west-east direction, and traffic signal 102*d* may direct the flow of motorized users in the north-south direction. Crosswalk signals 104 are traffic signals that direct the flow of non-motorized traffic through intersection 100. For example, crosswalk signals 104*a* and 104*b* may direct the flow of non-motorized users in the east/west direction on the north side of intersection 100, crosswalk signals 104*c* and 104*d* may direct the flow of non-motorized users in the north/south direction on the east side of intersection 100, crosswalk signals 104*e* and 104*f* may direct the flow of non-motorized users in the east/west direction on the south side of intersection 100, and crosswalk signals 104*g* and 104*h* may direct the flow of non-motorized users in the north/south direction on the west side of intersection 100.

Sensors 106 may be configured to autonomously detect the presence of motorized and non-motorized users at or approaching intersection 100. In some embodiments, sensors 106 may be video cameras that are configured to acquire images of intersection 100 from which motorized user presence and non-motorized user presence may be determined. The images may be classified as motorized user presence data, non-motorized presence data, or both. The acquired images may be provided to agent 108 for processing. Agent 108 is further described below in conjunction with FIG. 3. In some embodiments, at least some of sensors 106 may be air quality monitors, metal detectors, infrared detectors, crosswalk buttons, etc.

Figure 2:
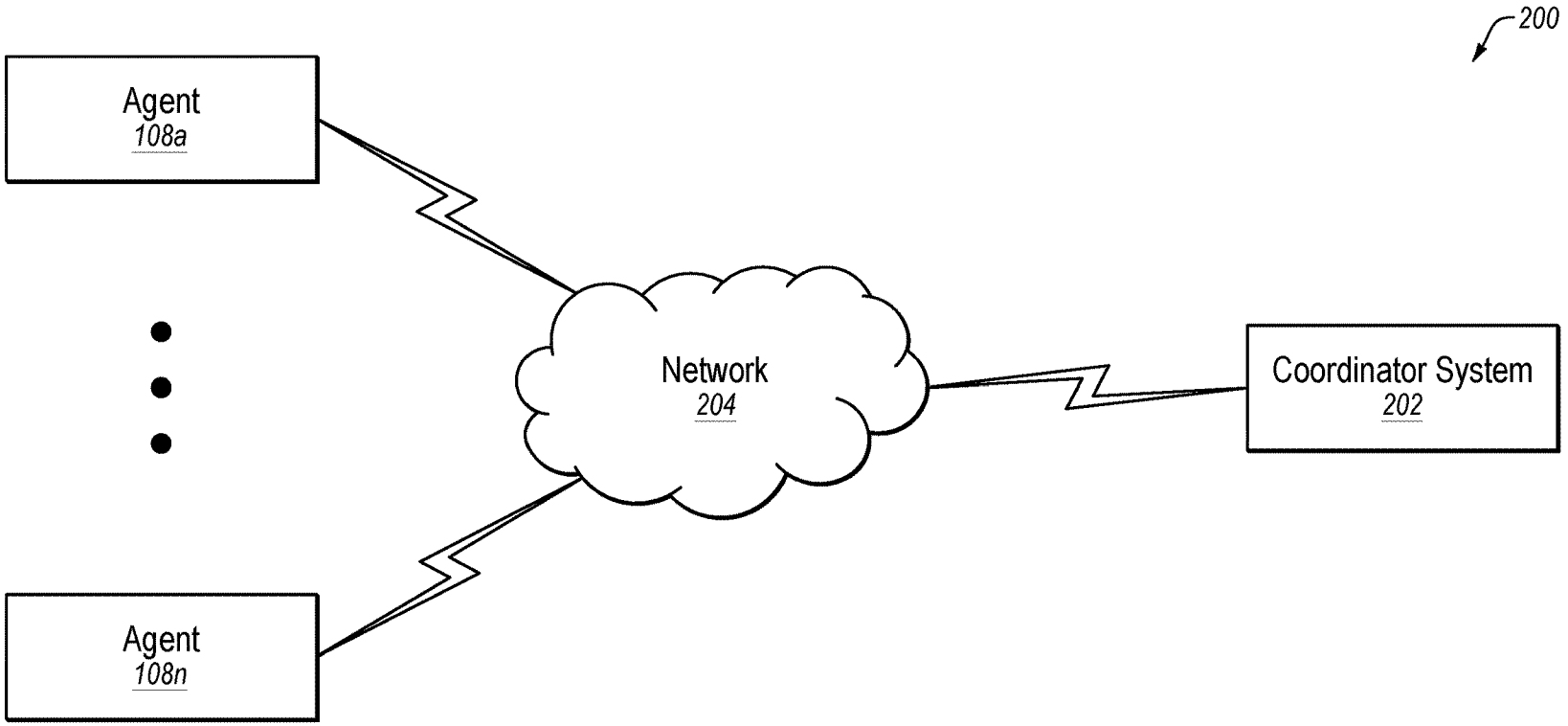
FIG. 2 illustrates an overview of an environment and selected devices in the environment.

FIG. 2 illustrates an overview of an environment 200 and selected devices in environment 200, arranged in accordance with at least some embodiments described herein. Environment 200 may include one or more agents 108*a*-108*n*, further described below in conjunction with FIG. 3. Agents 108*a*-108*n* may be individually referred to herein as agent 108 or collectively referred to herein as agents 108. The number of agents depicted in environment 200 is for illustration, and one skilled in the art will appreciate that there may be a different number of agents 108. Agents 108*a*-108*n* are illustrated as operating in a networked environment using logical connections to each other and one or more remote computing systems, e.g., a coordinator system 202, through a network 204. Network 204 can be a local area network, a wide area network, the Internet, and/or other wired or wireless networks.

Figure 3:
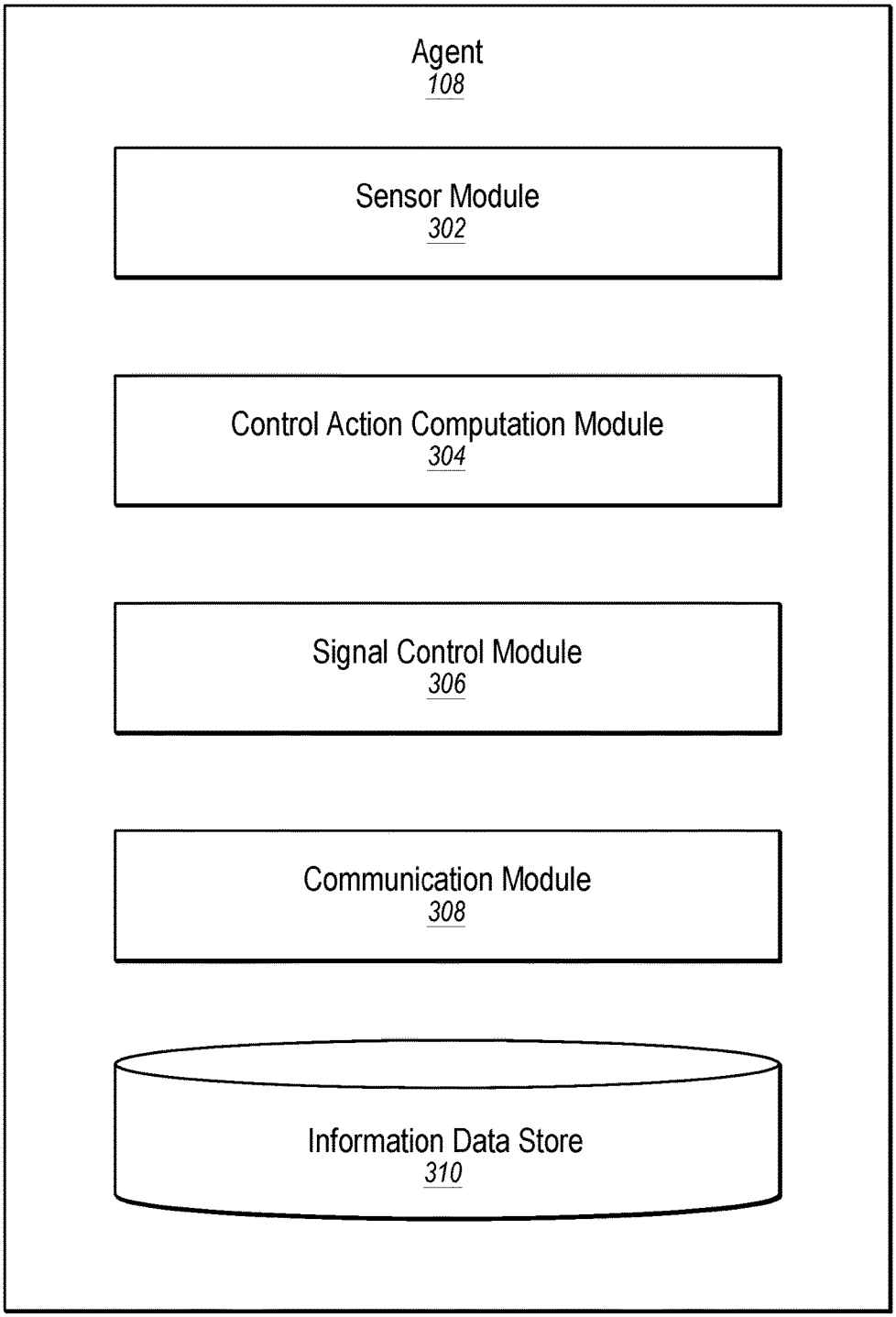
FIG. 3 illustrates selected components of an example agent.

FIG. 3 illustrates selected components of agent 108, arranged in accordance with at least some embodiments described herein. As depicted, agent 108 includes a sensor module 302, a control action computation module 304, a signal control module 306, a communication module 308, and an information data store 310. In various embodiments, additional components (not illustrated) or a subset of the illustrated components can be employed without deviating from the scope of the claimed technology.

Sensor module 302 may be configured to communicate with the sensors deployed at the intersection to receive (obtain) sensor data from the sensors. For example, in instances where the sensors are video cameras, sensor module 302 may receive the images and/or video feeds from the coupled sensors. In some embodiments, sensor module 302 may be configured to control the coupled sensors. For example, sensor module 302 may send the sensors instructions to operate the sensors (e.g., power on, power off, reboot, positioning and/or movement instructions, etc.).

Control action computation module 304 may be configured to control the traffic signals deployed at the intersection. For example, control action computation module 304 may generate a control action that directs the operation of the traffic signals at the intersection based on the sensor data obtained by sensor module 302. Accordingly, control action computation module 304 is able to generate control actions for the traffic signals (the traffic signals for motorized traffic and the traffic signals for non-motorized traffic) that account for the presence of motorized traffic and non-motorized traffic at the intersection. In some embodiments, control action computation module 304 may apply one or more constraints in generating the control actions for the traffic signals. Additionally or alternatively, control action computation module 304 may incorporate traffic data from one or more other agents (e.g., agents controlling other intersections) in generating the control actions for the traffic signals. Additionally or alternatively, control action computation module 304 may incorporate historical traffic data of the intersection and/or of one or more other intersections in generating the control actions for the traffic signals.

In some embodiments, control action computation module 304 may apply Q-learning to generate the control actions for the traffic signals that consider both motorized users and non-motorized users at an intersection. As discussed earlier, Q-learning can be used to determine an optimal action-selection policy for any given (finite) Markov decision process (MDP). Q-learning works by learning an action-value function that provides an expected utility of taking a given action (e.g., generating a given control action) in a given state (e.g., given state of the traffic signals) and following the optimal policy thereafter.

Figure 4:
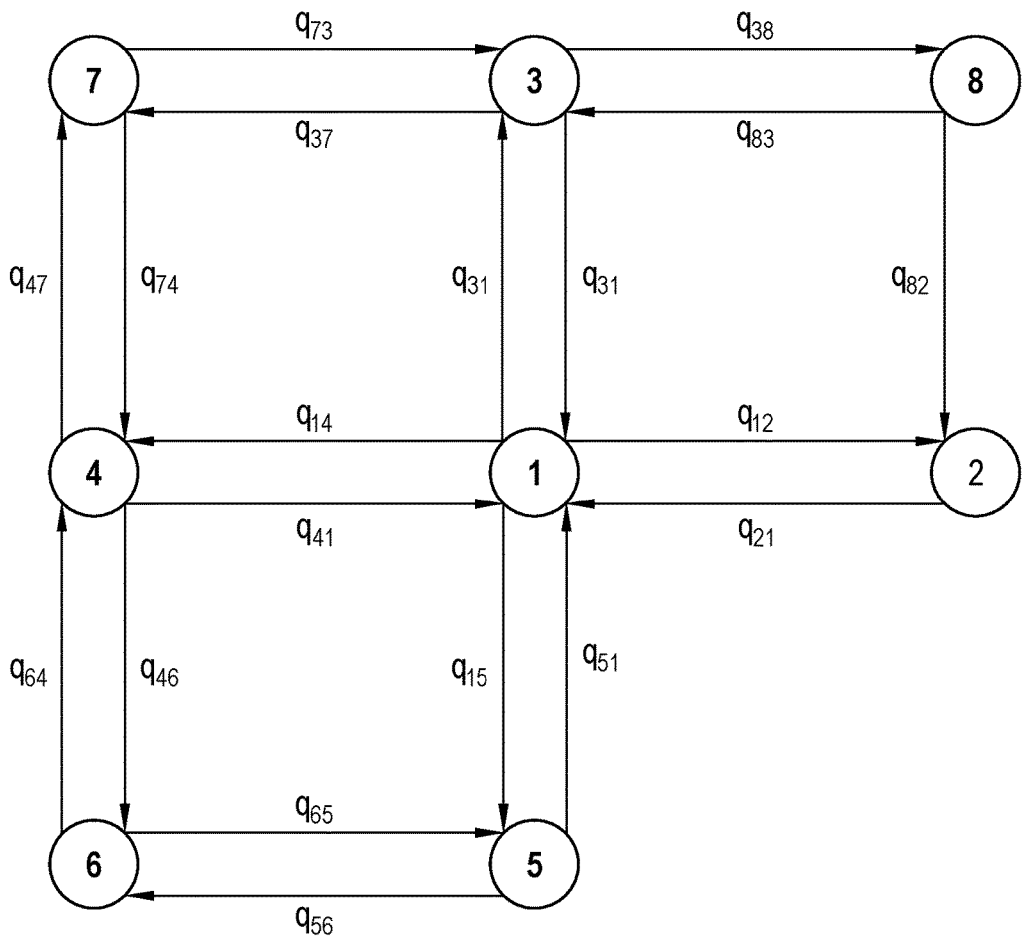
FIG. 4 illustrates an example directed graph corresponding to a segment of an example transportation network.

A transportation network (e.g., network of roads including intersections) may be abstracted into a directed graph. FIG. 4 illustrates an example directed graph corresponding to a segment of an example transportation network. Each intersection may be represented by a vertex in the directed graph, and a road may correspond to an edge in the directed graph. The flows (i.e., directed connections) may represent traffic, such as vehicular traffic, where $q_{ij}$ is the queue length from intersection i to intersection j. For example, as depicted in the directed graph, $q_{41}$ is the queue length from intersection 4 to intersection 1.

As an example, assume that the motorized users are vehicles, and the non-motorized users are pedestrians. Then, the various states of the traffic signals deployed at the intersection may be based on the number of vehicles and the number of pedestrians in the various queues in the incoming directions to the intersection. Thus, for any intersection i, the state of the traffic signals at the intersection is a set that contains all lengths of the queues, and may be represented as $$S^t_{i,d}=\{q^t_{1i,d}, q^t_{2i,d}, \ldots, q^t_{ji,d}, m^t_{1i,d,L}, m^t_{1i,d,R}, \ldots, m^t_{ji,d,L}, m^t_{ji,d,R}\}; j\epsilon N_i$$

where $S^t_{i,d}$ is the state of the traffic signals at intersection i, at day d and time t; $q^t_{ji,d}$ is the queue length for vehicles from intersection j to i, at day d and time t; $m^t_{ji,d,L}$ is the queue length for pedestrians at the left side from intersection j to i, at day d and time t; and $m^t_{ji,d,R}$ is the queue length for pedestrians at the right side from intersection j to i, at day d and time t. $S^t_{i,d}$ can vary for different t's since $q^t_{ji,d}$, $m^t_{ji,d,L}$, and $m^t_{ji,d,R}$ are subjected to stochastic process.

Figure 5:
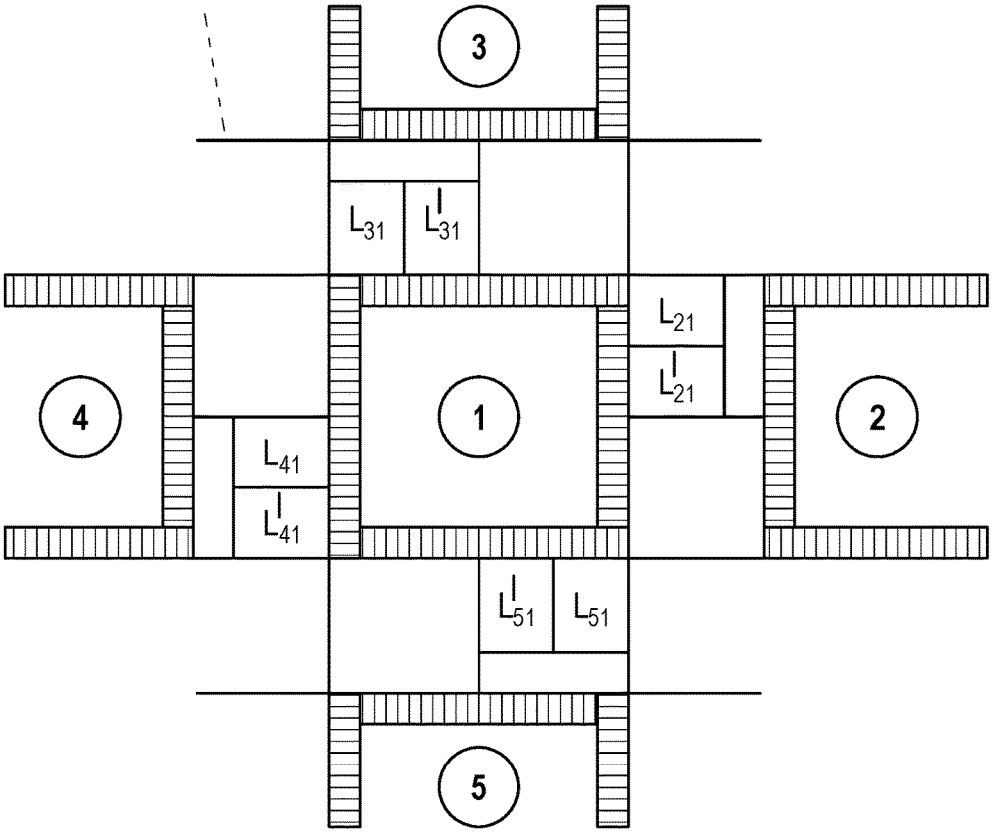
FIG. 5 illustrates a four-way, +-shape intersection.
Figure 6:
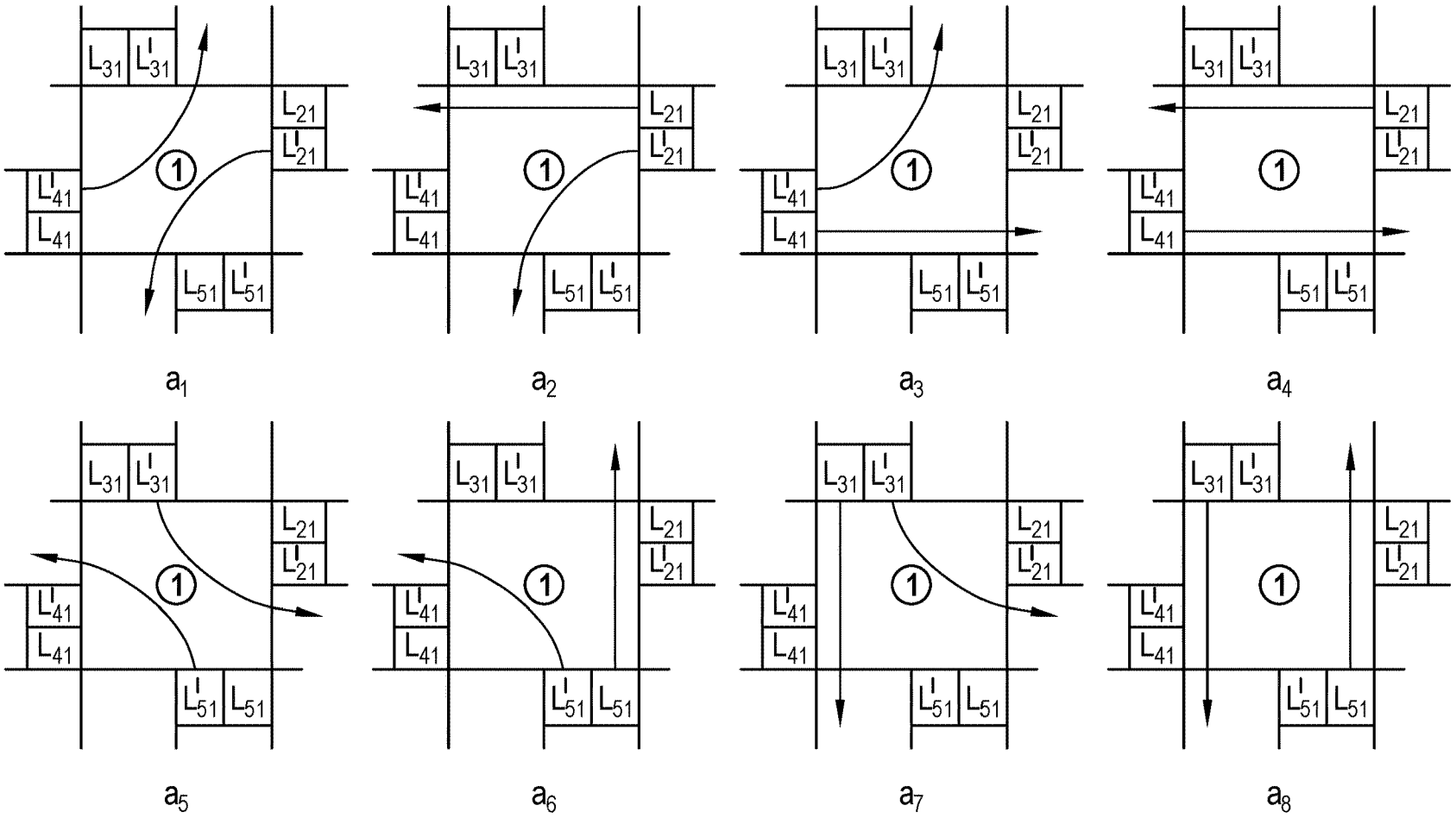
FIG. 6 illustrates an example action set for the four-way, +-shape intersection of FIG. 5.

For an action, a, the action set of possible actions, A, for the traffic signals at an intersection may be designed based on the traffic rules applicable to the location of the intersection. For an example four-way, +-shaped intersection as illustrated in FIG. 5, the action set may include eight possible actions, |A|=8, as dictated by the applicable traffic rules. Accordingly, only $\{a_i \epsilon A|i=1, 2, \ldots, 8\}$ actions may be chosen at any time slot, as illustrated by the example action set for the four-way, +-shape intersection (FIG. 6). As depicted in FIG. 6, $L_{ij}$ is the traffic signal that controls the flow of traffic from region i to region j, and $L'_{ij}$ is the left turn traffic signal that controls the flow of traffic from region i to region j. Note that the intersection itself is represented as region 1. Then the possible actions (i.e., the control actions for the traffic signals) may be represented as

| | $L_{21}$ | $L'_{21}$ | $L_{41}$ | $L'_{41}$ | $L_{31}$ | $L'_{31}$ | $L_{51}$ | $L'_{51}$ |
|---|---|---|---|---|---|---|---|---|
| $a_1$ | 0 | 1 | 0 | 1 | 0 | 0 | 0 | 0 |
| $a_2$ | 1 | 1 | 0 | 0 | 0 | 0 | 0 | 0 |
| $a_3$ | 0 | 0 | 1 | 1 | 0 | 0 | 0 | 0 |
| $a_4$ | 1 | 0 | 1 | 0 | 0 | 0 | 0 | 0 |
| $a_5$ | 0 | 0 | 0 | 0 | 0 | 1 | 0 | 1 |
| $a_6$ | 0 | 0 | 0 | 0 | 0 | 0 | 1 | 1 |
| $a_7$ | 0 | 0 | 0 | 0 | 1 | 1 | 0 | 0 |
| $a_8$ | 0 | 0 | 0 | 0 | 1 | 0 | 1 | 0 |

where "1" represents green light, and "0" represents red light.

Figure 7:
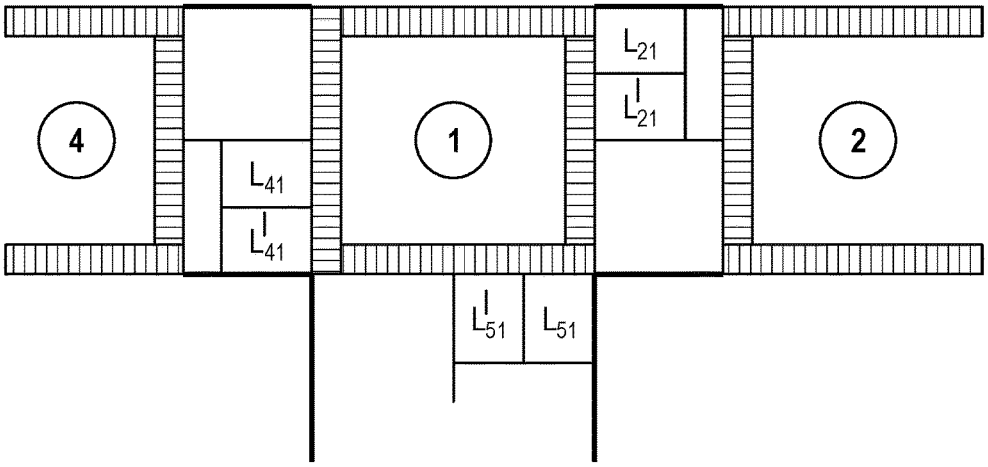
FIG. 7 illustrates a three-way, T-intersection.
Figure 8:
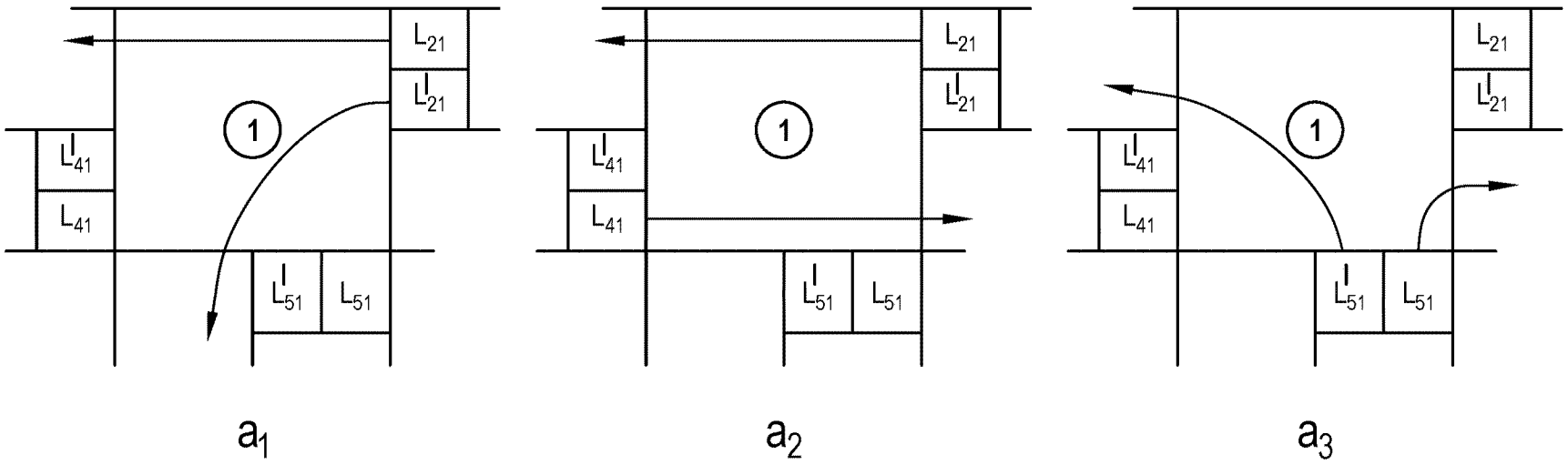
FIG. 8 illustrates an example action set for the three-way, T-shape intersection of FIG. 7.

Similarly, for an example three-way, T-intersection as illustrated in FIG. 7, the action set may include three possible actions, |A|=3, as dictated by the applicable traffic rules. Accordingly, only $\{a_i \epsilon A|i=1, 2, 3\}$ actions may be chosen at any time slot, as illustrated by the example action set for the three-way, T-shape intersection (FIG. 8). As depicted in FIG. 8, $L_{ij}$ is the traffic signal that controls the flow of traffic from region i to region j, and $L'_{ij}$ is the left turn traffic signal that controls the flow of traffic from region i to region j. Note that the intersection itself is represented as region 1. Then the possible actions (i.e., the control actions for the traffic signals) may be represented as

| | $L_{21}$ | $L'_{21}$ | $L_{41}$ | $L'_{41}$ | $L_{51}$ | $L'_{51}$ |
|---|---|---|---|---|---|---|
| $a_1$ | 1 | 1 | 0 | 0 | 0 | 0 |
| $a_2$ | 1 | 0 | 1 | 0 | 0 | 0 |
| $a_3$ | 0 | 0 | 0 | 0 | 1 | 1 |

where "1" represents green light, and "0" represents red light.

The time slot can be set based on operational policy. For example, the time slot can be set to a relatively longer time duration (e.g., 5 to 10 seconds) to avoid having to frequently change the traffic signals. Conversely, the time slot can be set to a relatively shorter time duration (e.g., 1 second) to obtain a faster Q-learning algorithm convergence. Thus, for a time period T, the probabilities for the actions may be represented as $$P\{a=a_i\}=N(a_i)/\Sigma_{i=1:|A|}N(a_i)$$

where $a_i$ is the action i in the set |A|, and $N(a_i)$ is the occurrence of $a_i$ in the time period T. For the +-shape intersection example above, suppose a sequence of actions for time period T may be

| | $a_1$ | $a_2$ | $a_3$ | $a_4$ | $a_5$ | $a_6$ | $a_7$ | $a_8$ |
|---|---|---|---|---|---|---|---|---|
| P $\{a = a_i\}$ | 1/10 | 1/10 | 0 | 3/10 | 1/10 | 1/10 | 1/10 | 1/5 |

Then the derived probabilities for each action within time period T are

| | | | | | | | | | |
|---|---|---|---|---|---|---|---|---|---|
| $a_1$ | $a_4$ | $a_4$ | $a_4$ | $a_7$ | $a_8$ | $a_8$ | $a_5$ | $a_6$ | $a_2$ |

0 T time

In the example, suppose that the objective is to minimize the length of all queues, both motorized and non-motorized user queues, at the intersection. Then, the immediate cost/reward at intersection i may be represented as $$R^t_{i,d}(a^t_{i,d}, a^t_{j,d}, S^t_{i,d}, S^t_{j,d}, W^t_{i,d})=(1/|N_i|)(w^t_{1,d}\Sigma_{j\epsilon Ni}q^t_{ji,d}+W^t_{2,d}\Sigma_{j\epsilon Ni}((1/|N_j|)\Sigma_{k\epsilon Nj}q^t_{kj,d})+(w^t_{3,d}/2)\Sigma_{j\epsilon Ni}(m^t_{ji,d,L}+m^t_{ji,d,R})) \quad [1]$$

where $R^t_{i,d}$ is the reward at intersection i, at day d and time t; $a^t_{i,d}$ is the action at intersection i, at day d and time t; $a^t_{j,d}$ is the action at intersection j, at day d and time t; $S^t_{i,d}$ is the state at intersection i, at day d and time t; $S^t_{j,d}$ is the state at intersection j, at day d and time t; $w^t_{1,d}$ is the weight to present the local vehicular queues at intersection i; $w^t_{2,d}$ is the weight to present the neighborhood vehicular queues at the neighbors ($j\epsilon N_i$) of intersection i; $w^t_{3,d}$ is the weight to present the total pedestrian queues at intersection i; $|N_i|$ is the number of neighboring intersections of intersection i; $q^t_{ji,d}$ is the queue length from intersection j to intersection i, at day d and time t; $m^t_{ji,d,L}$ is the queue length for pedestrians at the left side from intersection j to i, at day d and time t; and $m^t_{ji,d,R}$ is the queue length for pedestrians at the right side from intersection j to i, at day d and time t.

In equation [1] above, $\Sigma_{j\epsilon Ni}\, q^t_{ji,d}$ is the incoming vehicular queues from intersection j to intersection i; $\Sigma_{j\epsilon Ni}((1/|N_j|)\Sigma_{k\epsilon Nj}\, q^t_{kj,d})$ is the total vehicular queues at all neighbor intersection j's, including the outgoing vehicular traffic from intersection i to intersection j; and $\Sigma_{j\epsilon Ni}\,(m^t_{ji,d,L}+m^t_{ji,d,R})$ is the total pedestrian queues at intersection i. $|N_i|$ is 4 for a four-way, +-shaped intersection, and $|N_i|$ is 3 for a three-way, T-intersection. In equation [1], the three additive terms $\Sigma_{j\epsilon Ni}\, q^t_{ji,d}$, $\Sigma_{j\epsilon Ni}\,((1/|N_j|)\Sigma_{k\epsilon Nj}\, q^t_{kj,d})$, and $\Sigma_{j\epsilon Ni}\,(m^t_{ji,d,L}+m^t_{ji,d,R})$, have associated respective weights $w^t_{1,d}$, $w^t_{2,d}$, and $w^t_{3,d}/2$, where the weight correlates to the priority assigned to the additive term. That is, the higher the priority, the higher the weight. The total of the weights at the neighboring intersections at day d and time t, $W^t_d$, sum up to 1. Accordingly, for the three-way, T-intersection, $w^d_t=\{w^t_{1,d}, w^t_{2,d}, w^t_{3,d}\}$, where $w^t_{1,d}+w^t_{2,d}+w^t_{3,d}=1$.

According to equation [1], the reward, $R^t_{i,d}$, is the queue lengths at intersection i, at day d and time t. Accordingly, as the objective is to minimize the lengths of all queues at intersection i, an action that minimizes $R^t_{i,d}$ may be chosen.

As discussed above, in some embodiments, historical traffic data may be incorporated in the determination of the actions. For example, an autoregressive integrated moving average (ARIMA) model incorporated to calculate estimated instantaneous rewards based on historical traffic data at intersection i may be represented as $$R^t_{i,d}=\Sigma_{n=1:p}\alpha_n R^t_{i,d-n}+\epsilon_{i,d}+\Sigma_{n=1:q}\theta_n\epsilon^t_{i,d-n}$$

where $R^t_{i,d}$ is the rewards at intersection i, at day d and time t; n is the lag operator; p is the number of autoregressive terms (e.g., the number of days of historical traffic data to consider); q is the number of days for the moving-average terms; an are the parameters (e.g., weights) of the autoregressive part of the model; $\theta_n$ are the parameters (e.g., weights) of the moving-average part of the model; and $\epsilon^t_{i,d}$ are the error terms (e.g., the variance of queue lengths at the intersection) at intersection i of day d. Again, as the objective is to minimize the lengths of all queues at intersection i, an action that minimizes $R^t_{i,d}$ may be chosen.

In some embodiments, traffic data of an intersection may be broadcast to neighbor intersections. Accordingly, traffic data from neighboring intersections may be incorporated to determine the actions at a particular intersection. Suppose the traffic data is queue lengths, then at intersection j, the traffic data from neighboring intersections may be represented as $$T^t_j=\Sigma_{k\epsilon Nj}q^t_{kj,d}/|N_j|$$

where $T^t_j$ is the average vehicular queue length at time t from all neighbor intersections of intersection j; $q^t_{kj,d}$ is the queue length for vehicles from intersection k to j, at day d and time t; and $|N_j|$ is the number of neighboring intersections of intersection j. It follows that the sum of all the neighbors' average queue lengths is $\Sigma T^t_j$, which can replace the middle additive term in equation [1] above.

In some embodiments, one or more constraints may need to be applied in determining an action. In normal operation, it may be that certain actions cannot follow other actions. For example, in the four-way, +-shaped intersection example above, the constraints on the actions may specify that, if the action at day d and time t is 1 ($a^t_{i,d}$, $i\epsilon 1$), then the action at day d at time t+1 cannot be 5, 6, 7, or 8 ($a^{t+1}_{i,d}$, $j\epsilon\{5, 6, 7, 8\}$); if the action at day d and time t is 5 ($a^t_{i,d}$, $i\epsilon 5$), then the action at day d at time t+1 cannot be 1, 2, 3, or 4 ($a^{t+1}_{i,d}$, $j\epsilon\{1, 2, 3, 4\}$); if the action at day d and time t is 2 or 3 ($a^t_{i,d}$, $i\epsilon\{2, 3\}$), then the action at day d at time t+1 cannot be 5 ($a^{t+1}_{i,d}$, $j\epsilon\{5\}$); and if the action at day d and time t is 5 or 7 ($a^t_{i,d}$, $i\epsilon\{5, 7\}$), then the action at day d at time t+1 cannot be 1 ($a^{t+1}_{i,d}$, $j\epsilon\{1\}$). As equation [1] above does not account for any constraints on actions, one solution to account for the constraints may be to sort the Q values in ascending order (i.e., priority queue), then select the smallest one that does not satisfy the constraints. Another solution may be to assign the rewards to a very large number, e.g., $R^t_d$ ($a^t_{i,d}$, $a^t_{j,d}$, $s^t_d$=MAX, if the constraints are satisfied, where $R^t_d$ is the reward at day d and time t, $a^t_{i,d}$ is the action at day d and time t, and $s^t_d$ is the state at day d and time t. Assigning the rewards to a very large number will result in the action not being selected.

An example of another constraint may be that a traffic signal that is directing pedestrians to cross an intersection should not turn red while the pedestrians are crossing the intersection. One solution to account for this constraint may be to set the time slot to a longer duration to provide sufficient time for pedestrians to cross the intersection. Another solution may be to maintain the current time slot (e.g., the relatively short duration), but change actions only when no pedestrian is crossing the intersection. For example, sensors deployed at the intersections may be able to provide information that may be used to determine whether a pedestrian is crossing the intersection. Another solution may be to not change the action for a specific number of time slots if a pedestrian is crossing the intersection.

Signal control module 306 may be configured to communicate with the traffic signals at the intersection to control (direct) operation of the traffic signals based on the control action generated by control action computation module 304. For example, signal control module 306 may control operation of the traffic signals by transmitting instructions (e.g., electrical signals or other signals depending on the type of traffic signal, etc.) that direct the operation of the traffic signals. Communication module 308 may be configured to couple to one or more remote computing devices or computing systems, such as, by way of example, other remote agents 108, coordinator system 202, etc. Accordingly, communication module 308 may facilitate communication by agent 108 with one or more external components. For example, control action computation module 304 may utilize communication module 308 to communicate with a neighboring agent, for example, to receive traffic data of the neighboring intersection. In some embodiments, sensor module 302 and/or signal control module 306 may utilize communication module 308 to communicate with the sensors and/or the traffic signals, respectively. Information data store 310 may be configured to store data, such as, by way of example, traffic data, sensor data, or other data that may be used by agent 108. Information data store 310 may be implemented using any computer-readable storage media suitable for carrying or having data or data structures stored thereon.

Figure 9:
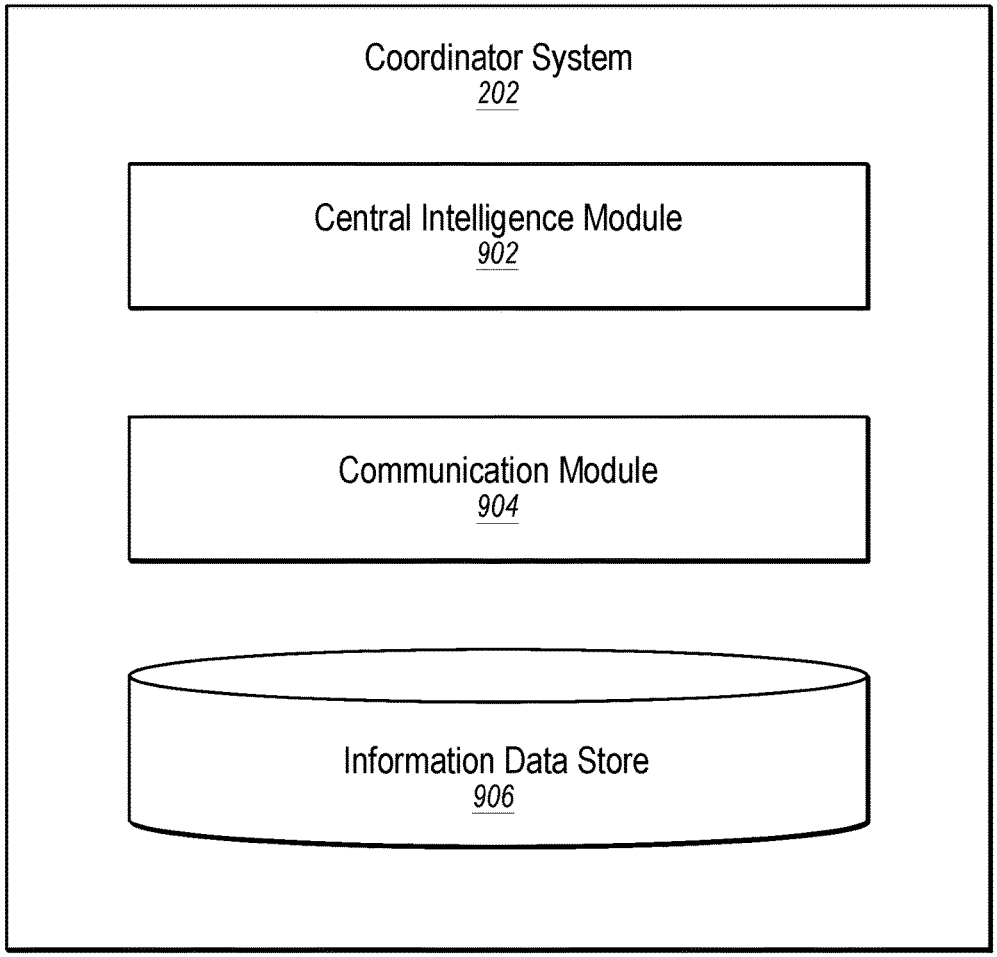
FIG. 9 illustrates selected components of an example coordinator system.

FIG. 9 illustrates selected components of coordinator system 202, arranged in accordance with at least some embodiments described herein. As depicted, coordinator system 202 includes a central intelligence module 902, a communication module 904, and an information data store 906. In various embodiments, additional components (not illustrated) or a subset of the illustrated components can be employed without deviating from the scope of the claimed technology.

Central intelligence module 902 may be configured to communicate with one or more agents 108 to receive (obtain) traffic data (e.g., current traffic data, historical traffic data, sensor data, operating data, etc.) from agents 108. Central intelligence module 902 may also provide traffic data to one or more agents 108, for example, for use in generating control actions and/or otherwise controlling the respective intersections.

In some embodiments, central intelligence module 902 may be configured to provide route information for use by one or more agents. For example, motorized users and/or non-motorized users may provide their travel route information. Central intelligence module 902 may process the travel route information to determine the travel route information relevant to a geographic area (e.g., one or more intersections, etc.). Central intelligence module 902 can then provide the agent or agents controlling the one or more intersections the relevant travel route information for use by the agent or agents, for example, to generate the control actions for the traffic signals.

Communication module 904 may be configured to couple to one or more remote computing devices or computing systems, such as, by way of example, one or more agents, one or more other coordinator systems, one or more traffic control systems, sources of remote data, etc. Similar to communication module 308 discussed above, communication module 904 facilitates communication by coordinator system 202 with one or more external components. For example, central intelligence module 902 may utilize communication module 904 to communicate with an agent, for example, to receive traffic data of the intersection being controlled by the agent. Information data store 906 may be configured to store data, such as, by way of example, traffic data, motorized user data, non-motorized user data, or other data that may be used by coordinator system 202. Similar to information data store 310, information data store 906 may be implemented using any computer-readable storage media suitable for carrying or having data or data structures stored thereon.

Figure 10:
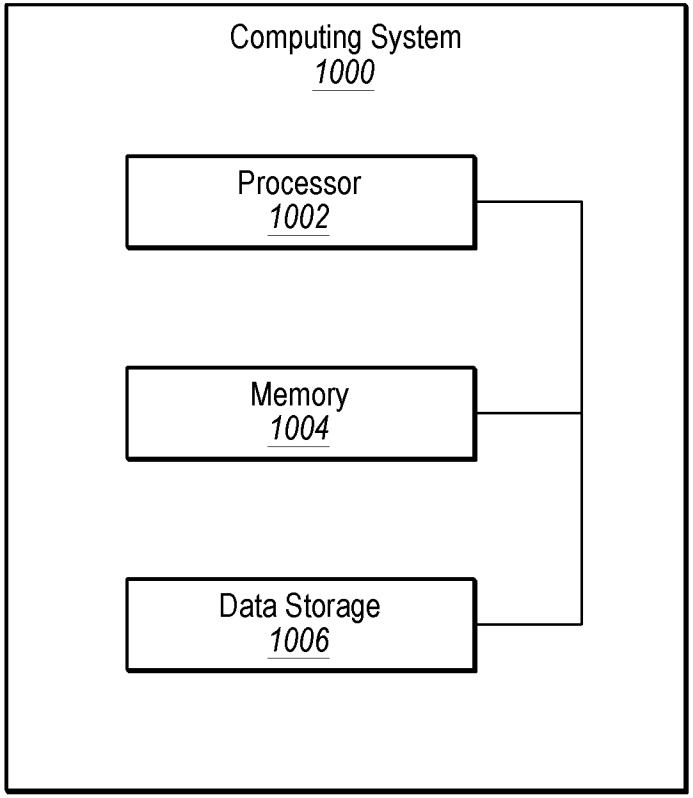
FIG. 10 illustrates selected components of an example general purpose computing system, which may be used to generate control actions for traffic signals at an intersection.

FIG. 10 illustrates selected components of an example general purpose computing system 1000, which may be used to generate control actions for traffic signals at an intersection, arranged in accordance with at least some embodiments described herein. Computing system 1000 may be configured to implement or direct one or more operations associated with some or all of the components and/or modules associated with agent 108 of FIG. 3 and/or coordinator system 202 of FIG. 9. Computing system 1000 may include a processor 1002, a memory 1004, and a data storage 1006. Processor 1002, memory 1004, and data storage 1006 may be communicatively coupled.

In general, processor 1002 may include any suitable special-purpose or general-purpose computer, computing entity, or computing or processing device including various computer hardware, firmware, or software modules, and may be configured to execute instructions, such as program instructions, stored on any applicable computer-readable storage media. For example, processor 1002 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data. Although illustrated as a single processor in FIG. 10, processor 1002 may include any number of processors and/or processor cores configured to, individually or collectively, perform or direct performance of any number of operations described in the present disclosure. Additionally, one or more of the processors may be present on one or more different electronic devices, such as different servers.

In some embodiments, processor 1002 may be configured to interpret and/or execute program instructions and/or process data stored in memory 1004, data storage 1006, or memory 1004 and data storage 1006. In some embodiments, processor 1002 may fetch program instructions from data storage 1006 and load the program instructions in memory 1004. After the program instructions are loaded into memory 1004, processor 1002 may execute the program instructions.

For example, in some embodiments, any one or more of the components and/or modules of agent 108 and/or coordinator system 202 may be included in data storage 1006 as program instructions. Processor 1002 may fetch some or all of the program instructions from the data storage 1006 and may load the fetched program instructions in memory 1004. Subsequent to loading the program instructions into memory 1004, processor 1002 may execute the program instructions such that the computing system may implement the operations as directed by the instructions.

Memory 1004 and data storage 1006 may include computer-readable storage media for carrying or having computer-executable instructions or data structures stored thereon. Such computer-readable storage media may include any available media that may be accessed by a general-purpose or special-purpose computer, such as processor 1002. By way of example, and not limitation, such computer-readable storage media may include tangible or non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store particular program code in the form of computer-executable instructions or data structures and which may be accessed by a general-purpose or special-purpose computer. Combinations of the above may also be included within the scope of computer-readable storage media. Computer-executable instructions may include, for example, instructions and data configured to cause processor 1002 to perform a certain operation or group of operations.

Modifications, additions, or omissions may be made to computing system 1000 without departing from the scope of the present disclosure. For example, in some embodiments, computing system 1000 may include any number of other components that may not be explicitly illustrated or described herein.

Figure 11:
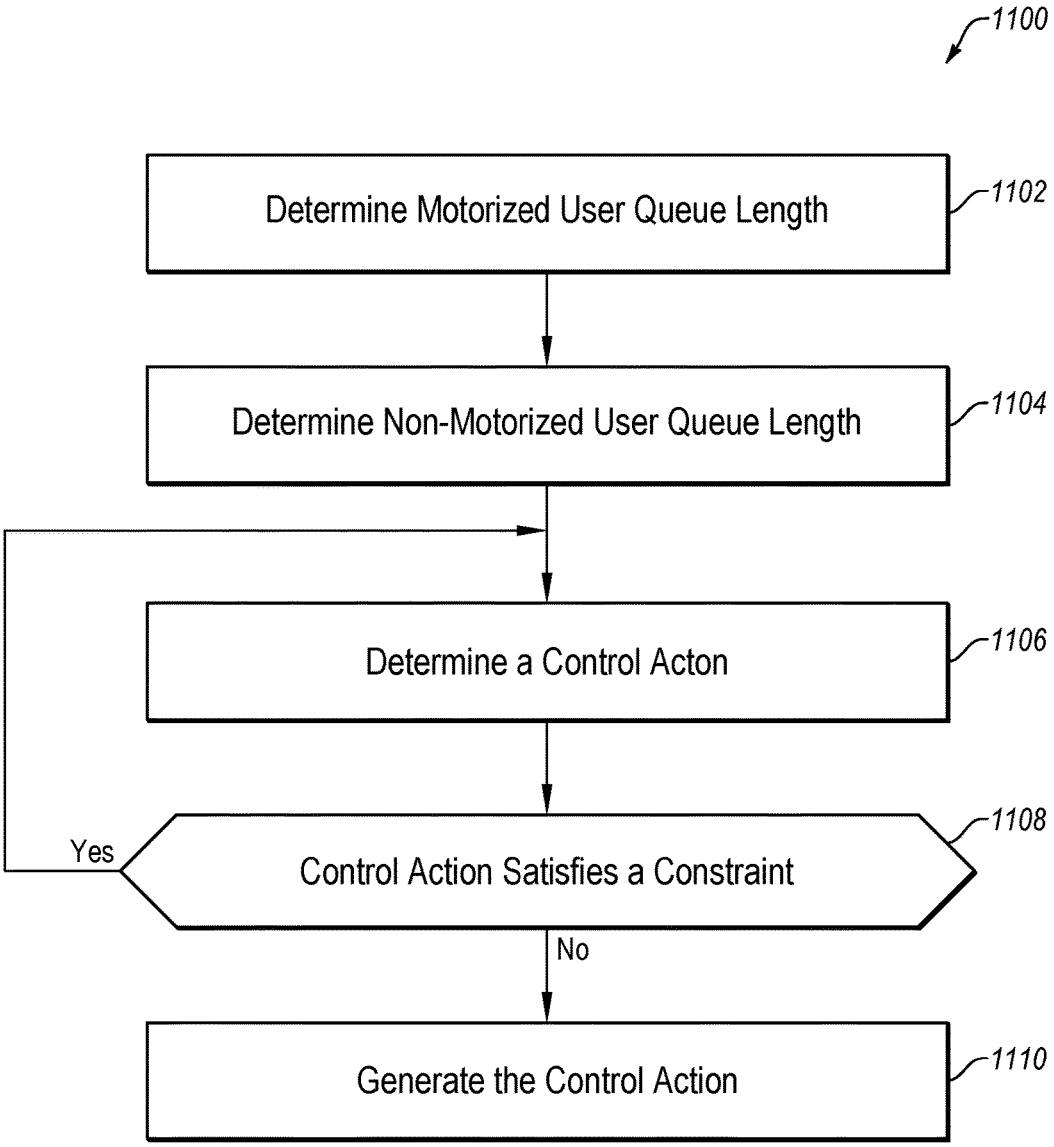
FIG. 11 is a flow diagram that illustrates an example process to generate control actions for traffic signals at an intersection based at least in part on a non-motorized user queue length that may be performed by an agent such as the agent of FIG. 3.

FIG. 11 is a flow diagram 1100 that illustrates an example process to generate control actions for traffic signals at an intersection based at least in part on a non-motorized user queue length that may be performed by an agent such as agent 108 of FIG. 3, arranged in accordance with at least some embodiments described herein. Example processes and methods may include one or more operations, functions or actions as illustrated by one or more of blocks 1102, 1104, 1106, 1108, and/or 1110, and may in some embodiments be performed by a computing system such as computing system 1000 of FIG. 10. The operations described in blocks 1102-1110 may also be stored as computer-executable instructions in a computer-readable medium such as memory 1004 and/or data storage 1006 of computing system 1000.

As depicted by flow diagram 1100, the example process to generate control actions for traffic signals at an intersection based at least in part on a non-motorized user queue length may begin with block 1102 ("Determine Motorized User Queue Length"), where an agent configured to control the traffic signals deployed at the intersection may determine the lengths of the motorized user queues at the intersection. Optionally, the agent may transmit the traffic data (e.g., the lengths of the motorized user queues), for example, to one or more neighboring agents and/or one or more traffic coordinator systems.

Block 1102 may be followed by block 1104 ("Determine Non-Motorized User Queue Length"), where the agent configured to control the traffic signals deployed at the intersection may determine the lengths of the non-motorized user queues at the intersection. Optionally, the agent may transmit the traffic data (e.g., the lengths of the non-motorized user queues), for example, to one or more neighboring agents and/or one or more traffic coordinator systems.

Block 1104 may be followed by block 1106 ("Determine a Control Action"), where the agent configured to control the traffic signals deployed at the intersection may determine an action (control action) for the traffic signals at the intersection based on the determined lengths of the motorized user queues and the non-motorized user queues. In some embodiments, the agent may incorporate historical traffic data of the intersection and/or one or more other intersections in determining the action. In some embodiments, the agent may incorporate traffic data of one or more neighboring intersections in determining the action.

Block 1106 may be followed by decision block 1108 ("Control Action Satisfies a Constraint?"), where the agent configured to control the traffic signals deployed at the intersection may determine whether the action satisfies a constraint (i.e., a constraint placed on the operation of the traffic signals). If the agent determines that the action satisfies any one of the constraints, decision block 1108 may be followed by block 1106 where the agent may determine another action for the traffic signals at the intersection.

Otherwise, if the agent determines that the action does not satisfy any of the constraints, decision block 1108 may be followed by block 1110 ("Generate the Control Action"), where the agent configured to control the traffic signals deployed at the intersection may control the traffic signals at the intersection according to the action (e.g., cause signal control module 306 to control operation of the traffic signals in a manner consistent with the action).

As indicated above, the embodiments described in the present disclosure may include the use of a special purpose or general purpose computer (e.g., processor 1002 of FIG. 10) including various computer hardware or software modules, as discussed in greater detail herein. Further, as indicated above, embodiments described in the present disclosure may be implemented using computer-readable media (e.g., the memory 1004 of FIG. 10) for carrying or having computer-executable instructions or data structures stored thereon.

As used in the present disclosure, the terms "module" or "component" may refer to specific hardware implementations configured to perform the actions of the module or component and/or software objects or software routines that may be stored on and/or executed by general purpose hardware (e.g., computer-readable media, processing devices, etc.) of the computing system. In some embodiments, the different components, modules, engines, and services described in the present disclosure may be implemented as objects or processes that execute on the computing system (e.g., as separate threads). While some of the system and methods described in the present disclosure are generally described as being implemented in software (stored on and/or executed by general purpose hardware), specific hardware implementations, firmware implements, or any combination thereof are also possible and contemplated. In this description, a "computing entity" may be any computing system as previously described in the present disclosure, or any module or combination of modulates executing on a computing system.

Terms used in the present disclosure and in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

All examples and conditional language recited in the present disclosure are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure.

What is claimed is:

1. A traffic signal control system configured to control traffic signals at an intersection, the system comprising:

at least one sensor configured to autonomously acquire motorized user presence data at an intersection;

at least one sensor configured to autonomously acquire non-motorized user presence data at the intersection; and an agent configured to determine a motorized user queue length based on the motorized user presence data, determine a non-motorized user queue length based on the non-motorized user presence data, and control the traffic signals based at least in part on the non-motorized user queue length;

wherein a state of one of the traffic signals at an intersection i, at a day d and a time t is represented as $S^t_{i,d}=\{q^t_{1i,d}, q^t_{2i,d}, \ldots, q^t_{ji,d}, m^t_{1i,d,L}, m^t_{1i,d,R}, \ldots, m^t_{ji,d,L}, m^t_{ji,d,R}\}$, and wherein $g^t_{ji,d}$ is a vehicle queue length for one or more vehicles from an intersection j to the intersection i, at the day d and the time t, and wherein $m^t_{ji,d,L}$ is a first pedestrian queue length for one or more pedestrians at a first side from the intersection j to the intersection i, at the day d and the time t and wherein $m^t_{ji,d,R}$ is a second pedestrian queue length for pedestrians at a second side from the intersection j to the intersection i, at the day d and the time t, and wherein the intersection j is a neighboring intersection to the intersection i.

2. The system of claim 1, wherein the agent is configured to incorporate traffic data of at least one neighbor intersection in the control of the traffic signals.

3. The system of claim 1, wherein the agent is configured to apply Q-learning in the control of the traffic signals.

4. The system of claim 3, wherein the agent is configured to apply at least one constraint on the operation of the traffic signals in the control of the traffic signals.

5. The system of claim 1, wherein the agent is configured to provide traffic data of the intersection to at least one neighbor intersection.

6. The system of claim 1, wherein the agent is configured to provide traffic data of the intersection to a remote coordinator system, wherein the remote coordinator system is configured to provide at least a portion of the traffic data to another intersection.

7. The system of claim 6, wherein the agent is configured to determine another non-motorized user queue length based on the motorized user presence data, and control the traffic signals based at least in part on the non-motorized user queue length and the another non-motorized user queue length.

8. The system of claim 1, wherein the agent is configured to incorporate historical traffic data of the intersection in the control of the traffic signals.

9. The system of claim 1, wherein the at least one sensor configured to autonomously acquire non-motorized user presence data is a video camera.

10. The system of claim 1, wherein the non-motorized user is a pedestrian.

11. The system of claim 1, wherein the agent is configured to receive traffic data from a remote coordinator system.

12. A method to control traffic signals at an intersection by an agent, the method comprising:

determining a motorized user queue length at the intersection based on motorized user presence data, the motorized user presence data being autonomously acquired;

determining a non-motorized user queue length at the intersection based on non-motorized user presence data, the non-motorized user presence data being autonomously acquired; and generating a control action for the traffic signals based at least in part on the non-motorized user queue length;

wherein a state of one of the traffic signals at an intersection i, at a day d and a time t is represented as $S^t_{i,d}=\{q^t_{1i,d}, q^t_{2i,d}, \ldots, q^t_{ji,d}, m^t_{1i,d,L}, m^t_{1i,d,R}, \ldots, m^t_{ji,d,L}, m^t_{ji,d,R}\}$, and wherein $q^t_{ji,d}$ is a vehicle queue length for one or more vehicles from an intersection j to the intersection i, at the day d and the time t, and wherein $m^t_{ji,d,L}$ is a first pedestrian queue length for one or more pedestrians at a first side from the intersection j to the intersection i, at the day d and the time t and wherein $m^t_{ji,d,R}$ is a second pedestrian queue length for pedestrians at a second side from the intersection j to the intersection i, at the day d and the time t, and wherein the intersection j is a neighboring intersection to the intersection i.

13. The method of claim 12, wherein generating the control action includes integrating traffic data of at least one neighbor intersection.

14. The method of claim 12, wherein generating the control action includes applying a Q-learning technique.

15. The method of claim 12, wherein generating the control action includes applying at least one constraint on the operation of the traffic signals.

16. The method of claim 12, further comprising determining historical traffic data, and generating the control action for the traffic signals based at least in part on the first non-motorized user queue length and the historical traffic data.

17. The method of claim 16, wherein the historical traffic data is of the intersection.

18. The method of claim 16, wherein the historical traffic data is of a neighbor intersection.

19. The method of claim 12, further comprising providing the traffic data of the intersection for use by at least one other agent.

20. A non-transitory computer-readable storage media storing thereon instructions that, in response to execution by a processor, causes the processor to:

determine a motorized user queue length at an intersection based on motorized user presence data, the motorized user presence data being autonomously acquired;

determine a non-motorized user queue length at the intersection based on non-motorized user presence data, the non-motorized user presence data being autonomously acquired; and generate a control action for traffic signals at the intersection based at least in part on the non-motorized user queue length;

wherein a state of one of the traffic signals at an intersection i, at a day d and a time t is represented as $S^t_{i,d}=\{q^t_{1i,d}, q^t_{2i,d}, \ldots, q^t_{ji,d}, m^t_{1i,d,L}, m^t_{1i,d,R}, \ldots, m^t_{ji,d,L}, m^t_{ji,d,R}\}$, and wherein $q^t_{ji,d}$ is a vehicle queue length for one or more vehicles from an intersection j to the intersection i, at the day d and the time t, and wherein $m^t_{ji,d,L}$ is a first pedestrian queue length for one or more pedestrians at a first side from the intersection j to the intersection i, at the day d and the time t and wherein $m^t_{ji,d,R}$ is a second pedestrian queue length for pedestrians at a second side from the intersection j to the intersection i, at the day d and the time t, and wherein the intersection j is a neighboring intersection to the intersection i.

* * * * *